US009085147B2

(12) United States Patent
Watanabe et al.

(10) Patent No.: US 9,085,147 B2
(45) Date of Patent: Jul. 21, 2015

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Katsumi Enomoto, Kanagawa-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/208,573

(22) Filed: Mar. 13, 2014

(65) Prior Publication Data

US 2014/0292909 A1 Oct. 2, 2014

(30) Foreign Application Priority Data

Mar. 27, 2013 (JP) ..... 2013-067438
Jul. 30, 2013 (JP) ..... 2013-157253

(51) Int. Cl.
*B41J 2/235* (2006.01)
*B41J 2/14* (2006.01)

(52) U.S. Cl.
CPC ..... *B41J 2/1433* (2013.01); *B41J 2002/14443* (2013.01)

(58) Field of Classification Search
USPC ..... 347/29
See application file for complete search history.

(56) References Cited

U.S. PATENT DOCUMENTS 4,702,631 A * 10/1987 Watanabe ..... 400/208
2003/0227516 A1* 12/2003 Yamaguchi et al. ..... 347/49

FOREIGN PATENT DOCUMENTS

JP 2008-296533 12/2008

* cited by examiner

*Primary Examiner* — Stephen Meier
*Assistant Examiner* — Alexander D Shenderov
(74) *Attorney, Agent, or Firm* — Workman Nydegger

(57) ABSTRACT

A case member is formed into a molded article and includes a wall-shaped enclosure projecting to face a printing medium side and forming a predetermined space. A plurality of projections are formed at positions apart from each other on a top portion of the wall-shaped enclosure. A cover member is fixed to tops of the plurality of projections and is set in an end section of the wall-shaped enclosure. With the projections, the height setting can be finely adjusted by finely adjusting of a mold during resin molding. It is thus possible to maintain a desired height with high accuracy.

13 Claims, 16 Drawing Sheets

LIQUID EJECTING HEAD AND LIQUID EJECTING APPARATUS

The present application claims priority to Japanese Patent Application No. 2013-067438 filed on Mar. 27, 2013 and Japanese Patent Application No. 2013-157253 filed on Jul. 30, 2013, which applications are hereby incorporated by reference in their entirety.

BACKGROUND

1. Technical Field

Embodiments of the present invention relate to a liquid ejecting head that ejects a liquid from a nozzle, and a liquid ejecting apparatus. More particularly, embodiments of the invention relate to an ink jet type recording head that ejects an ink, and an ink jet type recording apparatus.

2. Related Art

An ink jet type recording head is a representative example of a liquid ejecting head that ejects liquid drops. The ink jet type recording head includes a pressure generation chamber that communicates with a nozzle and a piezoelectric actuator that is disposed to face the pressure generation chamber. A pressure change is generated in the pressure generation chamber by a displacement of the piezoelectric actuator so that the ink drops are ejected from the nozzle.

Various structures have been proposed as the structure of such ink jet type recording heads. In general, a plurality of members are set (bonded together) using an adhesive or the like (for example, refer to JP-A-2008-296533).

In the structure of the ink jet type recording head shown in JP-A-2008-296533, facing parts of two members that constitute a printing head have concave and convex shapes, which are fitted into each other.

In a case where a head chip is compact in size, it is difficult to directly fix the head chip to a case member for reasons relating to accuracy. Thus the head chip may be put on a flat plate before fixing the flat plate to the case member. In this case, processing to form unevenness in the part fixed to the case member is avoided so as to maintain the degree of flatness of the flat plate. The case member is formed in such a manner that a surface fixed to the flat plate is as flat as possible. However, a fixing condition is affected by the degree of flatness of the fixing surface and the fixing may not be firm because the fixing surface between the flat plate and the case member has a wide range. Also, when cleaning the head, it is desirable that the flatness be maintained as much as possible because the surface is attracted by a cap for vacuuming.

This disadvantage is present not only in ink jet type recording heads that eject ink but also in liquid ejecting heads that eject liquid other than ink.

SUMMARY

An advantage of some embodiments of the invention is to provide a liquid ejecting head that is capable of setting a tabular member supporting a head chip flat, and a liquid ejecting apparatus.

According to an embodiment of the invention, a liquid ejecting head includes a case member that includes a communication path that causes ink to communicate or flow from an upstream side to a downstream side. The case member is resin-molded. The liquid ejecting head also includes a cover member in which a head chip is set. A wall-shaped enclosure is disposed the case member to form a predetermined space inside. The wall-shape enclosure is integrally molded with the case member and the wall-shaped enclosure is provided on a printing medium side of the case member. A plurality of projections are formed apart from or spaced apart from each other on a top of the wall-shaped enclosure. The cover member is fixed or bonded to the case member in or on a part of the projection of the case member to contain the head chip in the predetermined space formed by the wall-shaped enclosure. The head chip communicates with the communication path in the predetermined space.

In the above-described configuration, the wall-shaped enclosure that is disposed through the integral molding with the case member is provided on the printing medium side of the case member of the liquid ejecting head and the predetermined space is formed inside the wall-shaped enclosure. The plurality of projections are formed apart from each other on the top of the wall-shaped enclosure, and the cover member where the head chip is set is fixed to the case member in the part of the projection to contain the head chip in the predetermined space formed by the wall-shaped enclosure. The head chip communicates with the communication path in the predetermined space.

In other words, maintaining an end section of the wall-shaped enclosure with accuracy and at a desired height is difficult. Maintaining the end section with accuracy is significantly facilitated when height adjustment is performed by forming the projections. For example, with the projections, the height setting can be finely set through a fine adjustment of a mold during the molding process where the member is molded from resin.

According to an embodiment of the invention, the fine height setting is possible by finely adjusting the mold during the resin molding with the projections. Because the height setting can be adjusted by finely adjusting the height of the projections formed on the wall-shaped enclosure, the degree of flatness of the cover member can reach a desired degree.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments of the invention will be described in detail.

Figure 1:
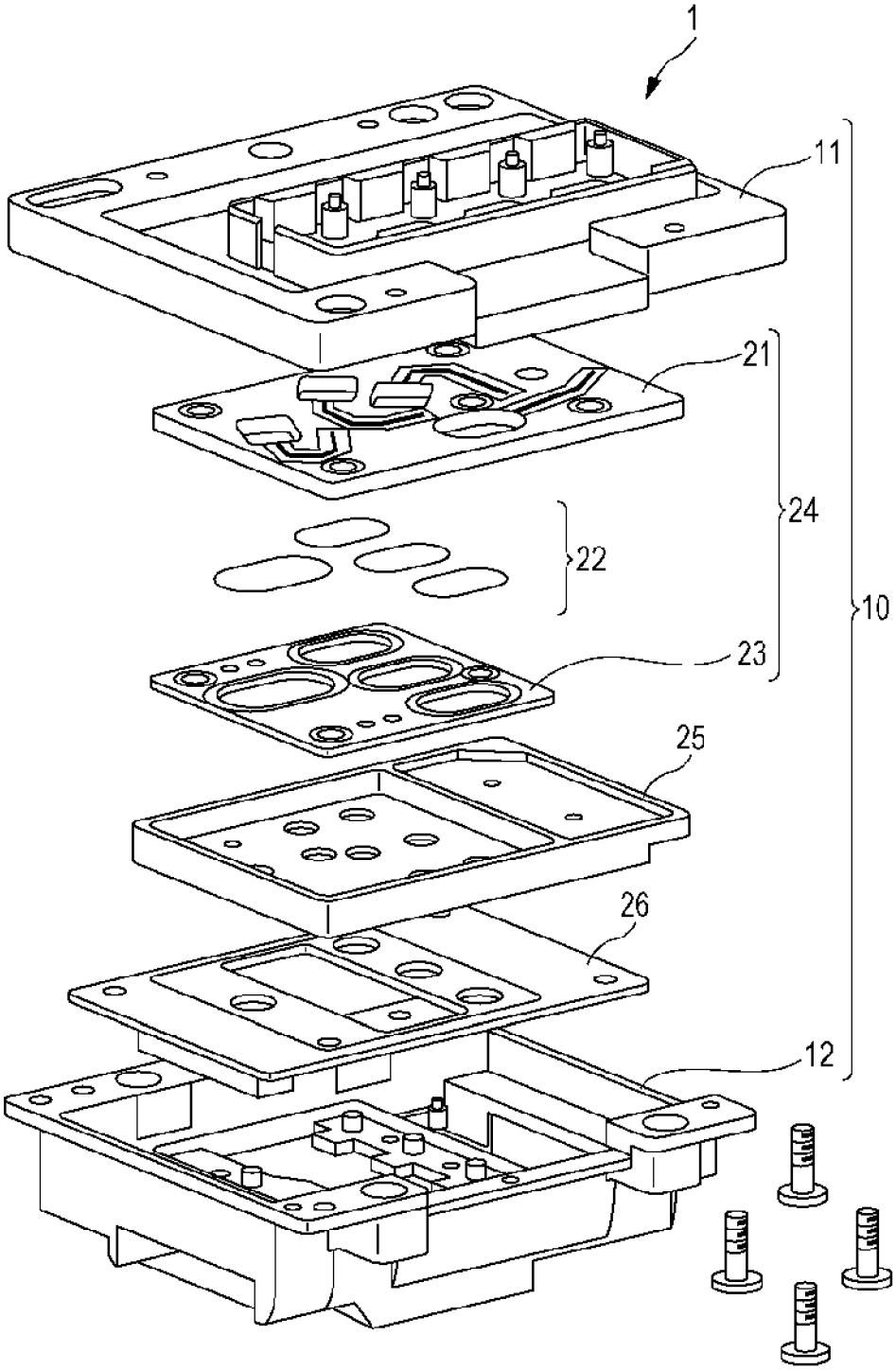
FIG. 1 is a development view of an example of an upper side of a liquid ejecting head.
Figure 2:
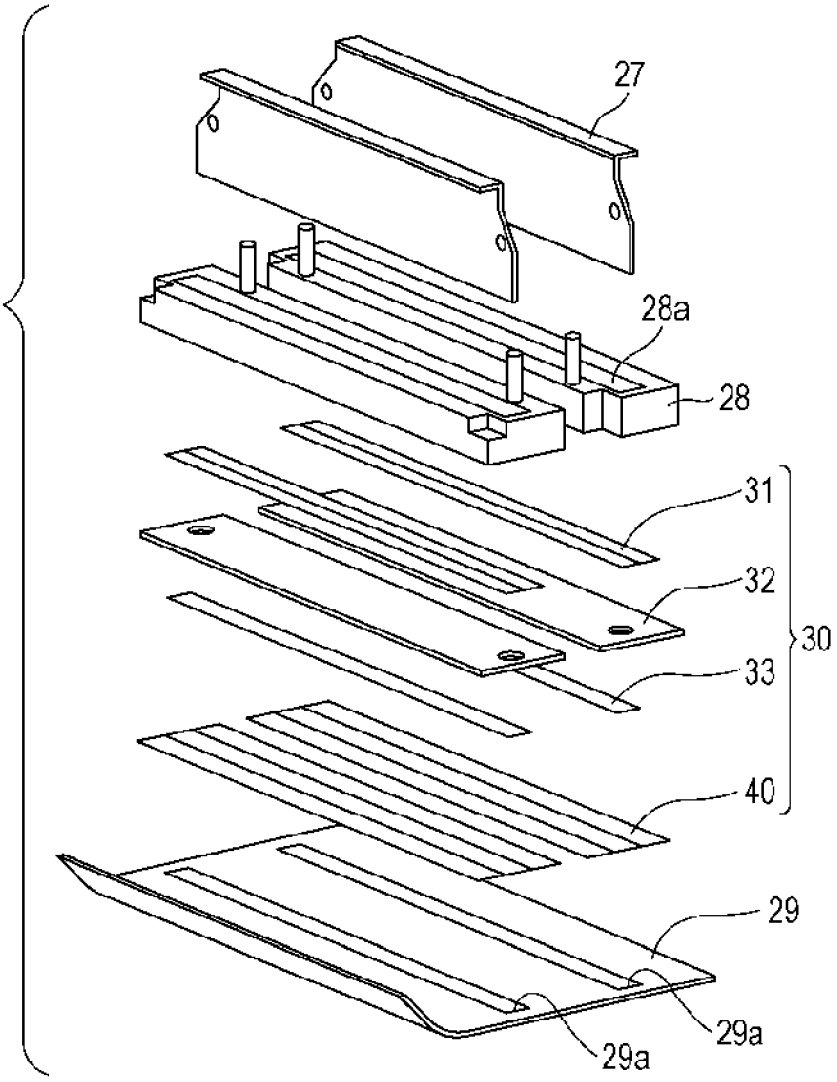
FIG. 2 is a development view of an example of a lower side of the liquid ejecting head.
Figure 3:
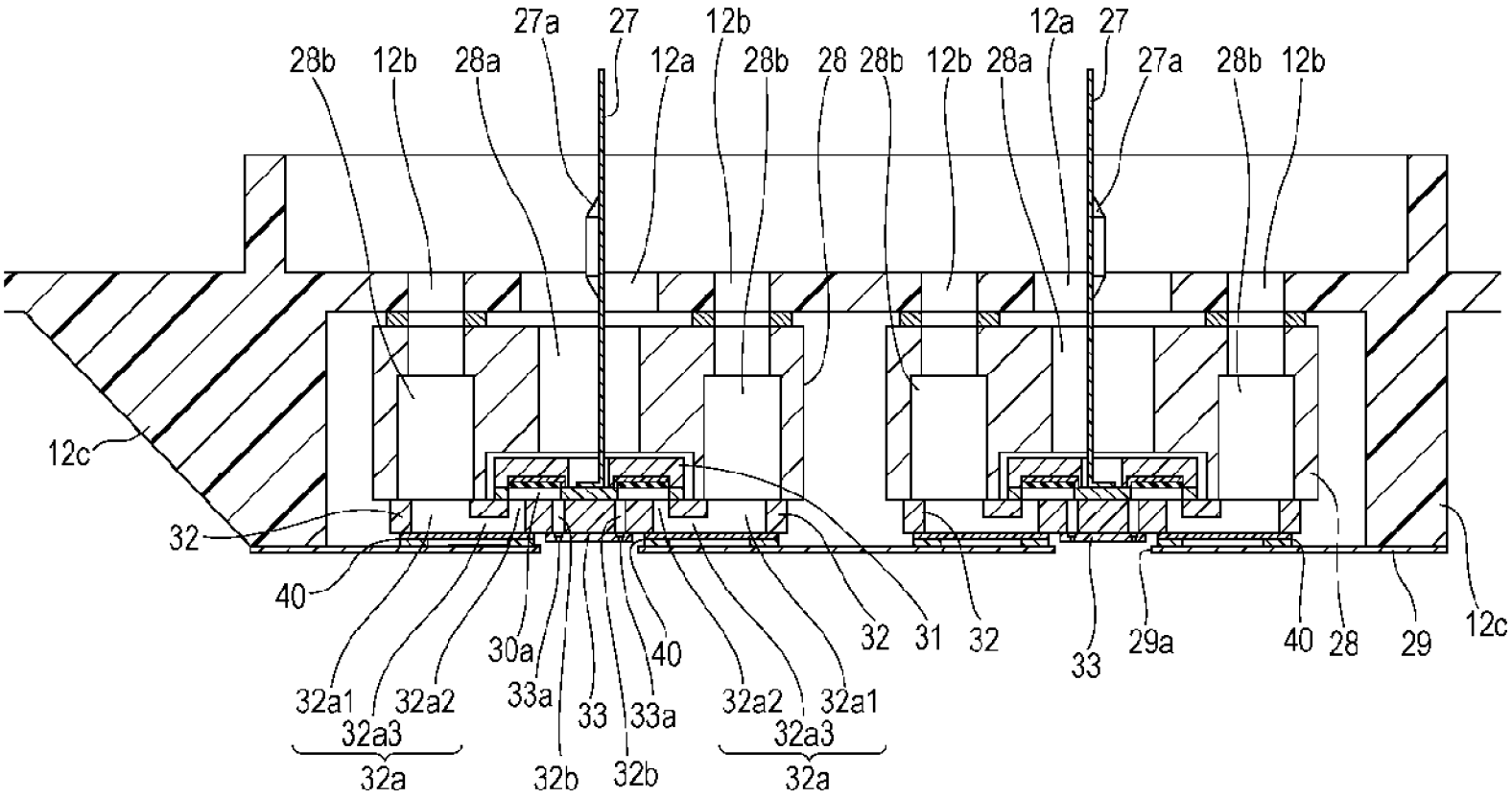
FIG. 3 is a cross-sectional view of a vicinity of a head chip.

FIGS. 1 and 2 are development views of an ink jet type recording head showing an example of a liquid ejecting head according to an embodiment of the invention. FIG. 3 is a cross-sectional view of a vicinity of a head chip of the ink jet type recording head.

As shown in FIGS. 1 and 2, an ink jet type recording head 1 is formed by accommodating respective parts in a case member 10 that includes an upper case member 11 and a lower case member 12. An upper space and a lower space are formed in the lower case member 12. A flow path member 24 that includes a first flow path member 21, a filter 22, and a second flow path member 23, a seal member 25, and a circuit substrate 26 are sequentially stacked from above and are accommodated in the upper space.

Also, a flexible substrate 27, a third flow path member 28, a head chip 30, and a cover member 29 are accommodated from above in the lower space and may be sequentially stacked. The head chip 30 includes a piezoelectric actuator part 31, a flow path forming plate 32, a nozzle plate 33, and a compliance member 40.

In the head chip 30, the piezoelectric actuator part 31 is fixed (e.g., bonded) to an upper surface of the flow path forming plate 32, and the nozzle plate 33 and the compliance member 40 are fixed to a lower surface of the flow path forming plate 32. The flow path forming plate 32 is formed into a substantially rectangular plate shape, and the piezoelectric actuator part 31 is formed into a substantially strip shape and is set on the upper surface of a central part of the flow path forming plate 32 in a short direction. The piezoelectric actuator part 31 includes pressure chambers 30*a* that open downward. A ceiling wall of the pressure chamber 30*a* may be bent or flexed in an up-down direction to allow a pressure change to be generated in the pressure chamber 30*a*.

An elastic membrane, an insulator film, and individual piezoelectric actuators, each of which includes a first electrode, a piezoelectric body layer, and a second electrode are formed on the ceiling wall of the pressure chamber 30*a*. In this context, the piezoelectric actuator part 31 may refer to an integrated part in which a required number of the individual piezoelectric actuators are formed in one example. Also, the first electrode may function as an individual electrode that is independent of each of the piezoelectric actuators, and the second electrode may function as a common electrode that is common to a plurality of the piezoelectric actuators. Also, the first electrode may be connected to one end of a lead electrode, and a drive circuit 27*a* that is formed on the flexible substrate 27 may connected to the other end of the lead electrode.

In one example, two pressure chambers 30*a* are formed in the short direction, and a predetermined number thereof are formed in two rows, lined up in a longitudinal direction. The flexible substrate 27 extends in the longitudinal direction and is connected to a gap in the center between the two pressure chambers 30*a* and 30*a* which are lined up in the short direction. The flexible substrate 27 supplies driving power to the individual piezoelectric actuators in the two rows of the pressure chambers 30*a* and 30*a* that are positioned on both sides as described above.

Each of the pressure chambers 30*a* faces a flow path 32*a* and a nozzle hole 32*b* that are formed on the flow path forming plate 32 on a lower surface thereof. Ink, which is an example of a discharge liquid, is supplied from a flow path 32*a* side to the pressure chamber 30*a*, and the ink is pushed to a nozzle hole 32*b* side by the pressure change in the pressure chamber 30*a*. The nozzle holes 32*b* and 32*b* are also arranged in a row, formed in two rows, in a longitudinal direction in the center of the short direction to correspond to the two rows of the pressure chambers 30*a*. Likewise, two rows of the flow paths 32*a* and 32*a* are formed on a short-direction outer side. The pressure chamber 30*a* is set in a liquid-tight manner by an adhesive or the like on the flow path forming plate 32.

An inlet 32*a*1 (which is a flow path or part of the flow path 32*a*) and an outlet 32*a*3 (which is a flow path or part of the flow path 32*a*) of the flow path forming plate 32 are common communication paths, and a flow path 32*a*2 is an individual communication path. The upper surface is open at an outer-side inlet 32*a*1 and an inner-side outlet 32*a*2, and both communicate with each other at the central flow path 32*a*3 that is open to the lower surface. The central flow path 32*a*3 is open on the short-direction outer side of the nozzle hole 32*b*. Thus the elongated central flow paths 32*a*3 and 32*a*3 are open to the outer side and the two nozzle holes 32*b* and 32*b* are open to the inner side thereof when the flow path forming plate 32 is viewed from below. These are formed to be lined up in the longitudinal direction.

The nozzle plate 33 is formed into a strip-like rectangular shape that extends in the longitudinal direction along the positions where the nozzle holes 32*b* and 32*b* of the flow path forming plate 32 are formed. In one example, two nozzles 33*a* and 33*a* are formed to face the two nozzle holes 32*b* and 32*b*. The ink that is pushed to the nozzle hole 32*b* side by the pressure change in the pressure chamber 30*a* is discharged to the outside from the nozzle 33*a*. In other words, the liquid drops are discharged. The nozzle plate 33 may be formed from an expensive silicon material. The nozzle 33*a* that is formed on the nozzle plate 33 is oriented downward in one example.

The nozzle plate 33 is attached along the positions where the nozzle holes 32*b* and 32*b* are formed, and thus the central flow paths 32*a*3 and 32*a*3 which are formed in two rows on an outer side thereof remain open and are not covered by the nozzle plate 33. The central flow paths 32*a*3 and 32*a*3 are covered by the compliance member 40.

Figure 4:
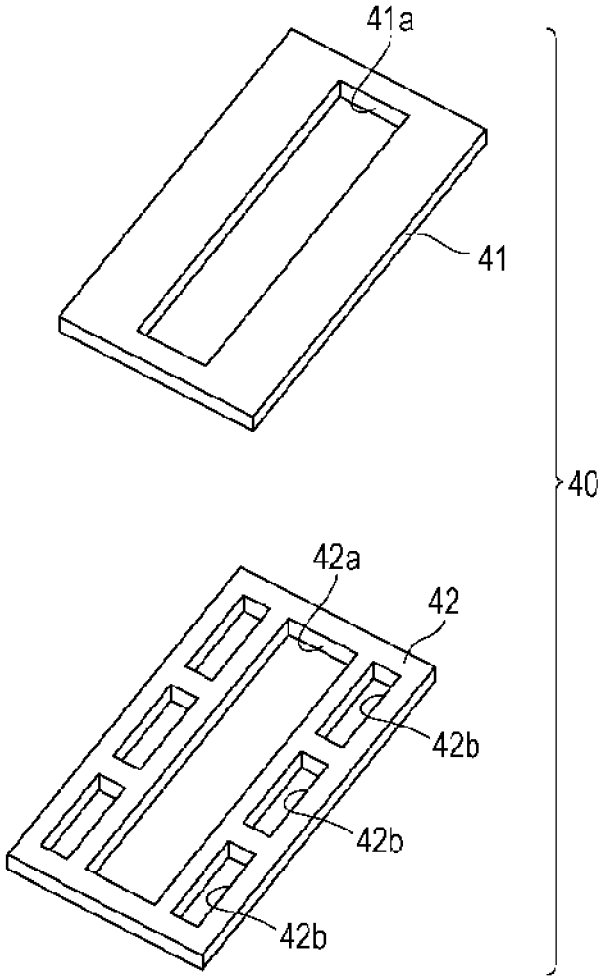
FIG. 4 is a schematic development view showing a configuration of an example compliance member.

FIG. 4 is a schematic development view showing a configuration of an embodiment of the compliance member. The compliance member 40 is configured to include an elastic membrane 41 that is an elastic membrane member, and a frame material 42 that is a supporting body. The frame material 42 includes a rectangular cut-out portion 42*a* in the center so that the compliance member 40 does not interfere with the nozzle plate 33. The frame material includes two rows of three window sections 42*b* in one example. The window sections 42*b* are formed to correspond to parts where the two rows of the central flow paths 32*a*3 and 32*a*3 are formed. The elastic membrane 41 is supported by the frame portion of the frame material 42 by attaching the elastic membrane 41 to the frame material 42. A cut-out portion 41*a* similar to the cut-out portion 42*a* is formed in the elastic membrane 41. One side of the an elastic membrane 41 is attached to the lower surface of the flow path forming plate 32 and each of the central flow paths 32*a*3 is sealed or covered by the elastic membrane 41. The window section 42*b* of the frame material 42 is formed or located on the opposite side of to the elastic membrane 41 relative to the central flow paths 32*a*3, and the elastic membrane 41 can be flexurally deformed by the same amount as the thickness of the window section 42*b*. Also, a groove may be formed in a part of the frame material 42 and a passage leading to the atmosphere is provided so that the window section 42*b* is not sealed. This may allow the elastic membrane 41 to be deformed.

Accordingly, the compliance member 40 forms a series of communication paths by covering the central flow path 32*a*3 that reaches the outlet 32*a*2 from the inlet 32*a*1 from below, and achieves a function as the compliance member during the course thereof. In other words, the compliance member 40 can seal the openings of the inlet 32*a*1, the outlet 32*a*2, and the flow path 32*a*3 on the compliance member side of the flow path substrate 32. A position where the compliance member 40 is mounted is not limited to the lower surface of the flow path forming plate 32. The compliance member 40 may be mounted in a vicinity of the outlet 32*a*2 side. In one example, the central flow path 32*a*3 may be blocked by another member to form only the communication path and may maintain the function as the compliance member at the other part.

A wall-shaped enclosure 12*c* that forms a space that can accommodate the head chip 30 and the third flow path member 28 is formed in a projecting manner at a lower end of the lower case member 12. The wall-shaped enclosure 12*c* projects in a cylindrical shape in one example to form the space inside. The wall-shaped enclosure 12*c* is formed to have a thickness larger than the thickness of the other wall surface of the lower case member 12. Because a cylindrical thick part is formed at the lower end of the lower case member 12, the lower case member 12 is unlikely to be bent in general, particularly around the wall-shaped enclosure 12*c* and around a part where the wall-shaped enclosure 12*c* is disposed. In one example, the wall-shaped enclosure 12*c* has a substantially square shape (e.g., cross-sectional shape) and a continuously linked cylindrical shape, but may not necessarily have the continuously linked shape. In other words, the wall-shaped enclosure 12*c* is effective in suppressing deformation or the like, for example based on bending, if disposed in a projecting manner through integral molding with the lower case member 12 so as to form a predetermined space inside the wall-shaped enclosure 12*c*. Thus, the wall-shaped enclosure 12*c* in integrally formed with the lower case member 12

The cover member 29 may be formed of stainless steel and may be thin to an extent of having elasticity. The cover member 29 is fixed to and covers an opening that is formed in the projecting end section. The projecting end section may be a top of the wall-shaped enclosure 12*c*.

In the cover member 29, an elongated opening 29*a* that exposes the nozzle plate 33 is formed in a planar section along a printing medium. In the area exposed by the opening 29*a* of the cover member 29, the head chip 30 and the cover member 29 are attached to and set in a compliance member 40 part of the head chip 30 in the planar section in the vicinity of the opening 29*a* of the cover member 29. The cover member 29 is not attached to and set in a nozzle plate 33 part of the head chip 30 that constitutes an ink flow passage. Thus the cover member 29 does not constitute part of the ink flow passage.

Also, the head chip 30 is fixed to a lower part of the lower case member 12 via the third flow path member 28. A through port 28*a* that extends in a longitudinal direction is formed in the center of the third flow path member 28, and the flexible substrate 27 is inserted via the through port 28*a*. The third flow path member 28 has a space formed in the vicinity of a lower-side opening of the through port 28*a* so as to be capable of accommodating the piezoelectric actuator part 31. The third flow path member 28 also includes a communication path 28*b* formed from an upper surface through or to a lower surface in a part other than the through port 28*a* so as to face the inlet 32*a*1 of the flow path 32*a* of the flow path forming plate 32. The third flow path member 28 and the flow path forming plate 32 are attached in a liquid-tight manner by an adhesive for example. According to the above-described configuration, communication is made from the communication path 28*b* to the pressure chamber 30*a* through the flow path 32*a*. Further, a series of passages of the ink that lead to the nozzle 33*a* via the nozzle hole 32*b* are formed.

The lower case member 12 includes a through-hole 12*a* and a case member communication path 12*b*. The through-hole 12*a* is formed to correspond to the through port 28*a* and the case member communication path 12*b* is formed to correspond to communication path 28*b* of the third flow path member 28. The third flow path member 28 is fixed from below to the lower case member 12 by an adhesive having flexibility which will be described later. In this case, the communication path 28*b* and the case member communication path 12*b* are set in such a manner as to communicate in a liquid-tight manner.

In this manner, the head chip 30 and the third flow path member 28 that are disposed in the space of the lower case member 12 are unlikely to be subjected to an external force because the lower case member is unlikely to be bent or deformed. The cover member 29 has elasticity that absorbs torsion generated between the head chip 30 and the lower case member 12 so that the head chip 30 is even more unlikely to be subjected to the external force. As such, peeling by or separation of the members that constitute the head chip 30 can be suppressed. In addition, ink leakage can be suppressed. Further, an adhesive having flexibility is even more effective when fixing or adhering the head chip 30 and the third flow path member 28, that is, the members that constitute the ink flow passage.

The position of the wall-shaped enclosure 12*c* where the cover member 29 is fixed is not limited to the opening on the top of the wall-shaped enclosure 12*c* as described above, but the position may include inner and outer side surfaces of the wall-shaped enclosure 12*c*. Also, the material of the cover member 29 is not limited to stainless steel. The cover member 29 may be a member having elasticity.

The nozzle plate 33 is formed to be thinner than the compliance member 40 in one example. Accordingly, the nozzle plate 33 has a positional relationship of not projecting to an outer side compared to the cover member 29 when positioned in the opening 29*a*. In other words, the cover member 29 projects out further than the nozzle plate 33 in a direction toward a recording medium and thus protects the nozzle plate 33 from impact.

Also, the nozzle plate 33 that may be formed of silicon with high precision is expensive. The nozzle plate 33 is therefore attached in such a manner as to cover only a necessary part of the flow path member 28. In one example, the nozzle plate 33 is wide enough to sufficiently cover the nozzle holes 32*b* and align the nozzles 33*a* with the nozzle holes 32*b*. This allows the nozzle late 33 to be small in size. Also, exposure from or through the opening 29*a* of the cover member 29 is suppressed to a minimum. The head chip 30 and the cover member 29 are attached to and set in the planar section in the vicinity of the opening 29*a* of the cover member 29 not in a part of the nozzle plate 33 but in a part of the compliance member 40.

In this manner, in the nozzle plate 33 that constitutes at least part of the ink flow passage of the head chip 30, a possibility of contact with the printing medium is suppressed to a minimum. The printing medium may come into contact with the cover member 29. However, the cover member 29 does not constitute the ink flow passage. As such, peeling or separation in the member or members that constitute the ink flow passage can be suppressed and, in addition, ink leakage can be suppressed in the member or members that constitute the ink flow passage.

Figure 5:
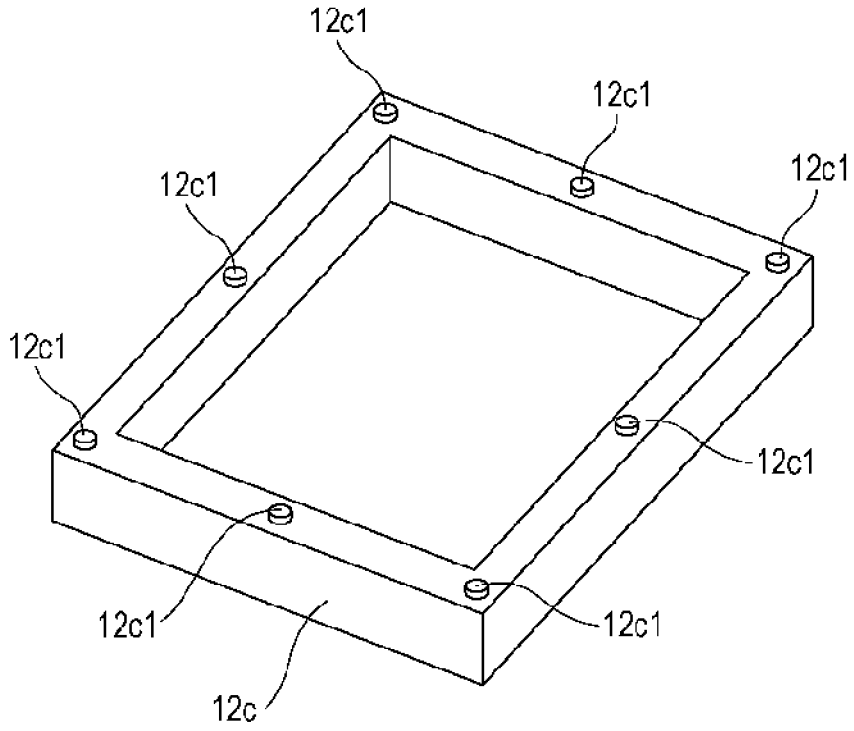
FIG. 5 is a schematic perspective view showing a bottom side of an example case member.
Figure 6:
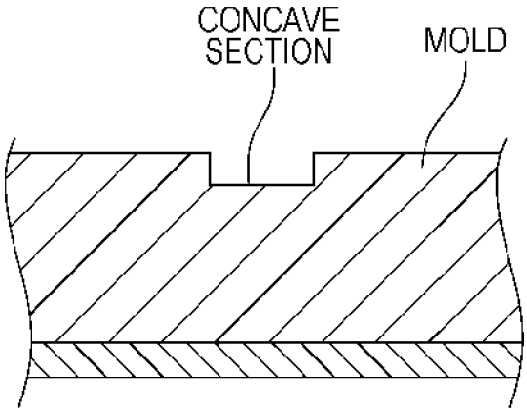
FIG. 6 is a cross-sectional view of a main part of an example mold.
Figure 7:
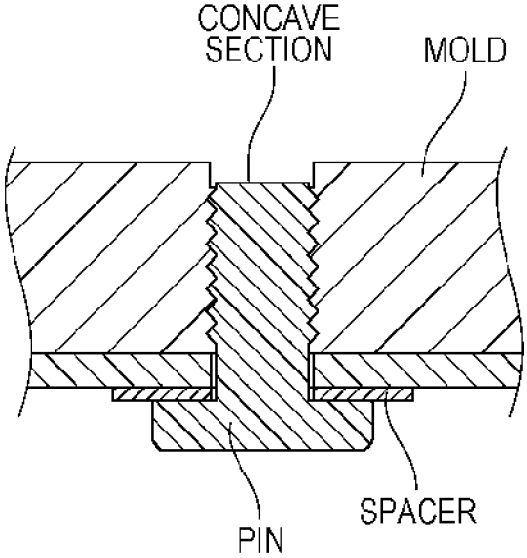
FIG. 7 is a cross-sectional view of the main part of the mold.

FIG. 5 is a schematic perspective view showing a bottom side of the lower case member. FIGS. 6 and 7 are cross-sectional views of a main part of a mold that forms the lower case member.

The wall-shaped enclosure 12*c* is formed to be thick as described above. The lower case member 12 itself is an article that may be integrally molded from a resin. In some cases, accuracy cannot be maintained in a thick part thereof as designed due to an effect of contraction during cooling of the resin. This does not necessarily mean the presence of individual irregularities but the generation of the same shift in the entire wall-shaped enclosure 12*c*. Even when the top of the wall-shaped enclosure 12*c* is intended to form a plane, the entire molded article may not be a plane due to shrinkage of the resin and the contraction of the resin during the molding. As stated above, finishing the wall-shaped enclosure 12*c* to form a plane across the entire top of the wall-shaped enclosure 12*c* is not easy.

In one embodiment, a plurality of projections 12*c*1 are formed apart from or spaced apart from each other in or on the top portion of the wall-shaped enclosure 12*c*. FIG. 5 illustrates an example where the projections 12*c*1 are formed in eight places in total including four corners of the wall-shaped enclosure 12*c*, which has a substantially rectangular cross section, and four places in the middle of each side. As a result, the top of each side of the wall-shaped enclosure 12*c* is a position where the projection 12*c*1 projects the most. The respective projections 12*c*1 may not have a uniform height from the top portion of the wall-shaped enclosure 12*c*.

First, the lower case member 12 that 12*c*1 is molded. The molded lower case member 12 does not have any projections 12*cd*1. Then, the position of the top of the wall-shaped enclosure 12*c* is measured. Then, it is determined how much to raise the top of the wall-shaped enclosure 12*c* while assuming a plane that is parallel with the plane formed by the head chip 30 when the third flow path member 28 which holds the head chip 30 is set in the lower case member 12. The amount of raising is determined, in one example, for each of the eight positions illustrated in FIG. 5. When the height of each raising is determined for the eight positions described above, concave portions corresponding to the respective heights are formed on a mold side or in the mold as shown in FIG. 6. Forming the concave portions on the mold side in this manner is easier than raising the inner portion. Also, finishing accuracy can be selected adequately.

Accordingly, the plane formed by the top of the projection 12*c*1 of the wall-shaped enclosure 12*c* can satisfy an intention of a designer by forming the concave portions with required accuracy in the mold and then using this mold. When the lower case member 12 is put upside down in this state and the cover member 29 is mounted from above the wall-shaped enclosure 12*c* in a state where the head chip 30 is set, the cover member 29 abuts against the top of the projection(s) 12*c*1 and is maintained in a plane without being affected by the shift generated in the wall-shaped enclosure 12*c* as described above. In a case where a plurality of the head chips 30 are set in the cover member 29, each of the head chips 30 can be arranged with high positional accuracy below the lower case member 12 since the plane is maintained.

In this case, the cover member 29 does not necessarily have to be in contact with the projection 12*c*1 in a strict sense, but even a state of abutting against many of the projections 12*c*1 and being in contact or out of contact with a small number of the projections 12*c*1 is allowable if the expected plane is maintained. Also, because the cover member 29 itself is attached to and set in or on the lower case member 12 in the first place using the adhesive applied to the top of the wall-shaped enclosure 12*c*, the adhesive may be interposed between the projection 12*c*1 and the cover member 29 so that the projection 12*c*1 and the cover member 29 are not in contact with each other in a strict sense.

In a case where the projection 12*c*1 is disposed not on a wall-shaped enclosure 12*c* side but on a cover member 29 side, there is a concern that distortion may occur in the cover member 29 during a process in which the projection 12*c*1 is formed in the cover member 29 to damage the planeness. As such, the projection 12*c*1 may be disposed on the wall-shaped enclosure 12*c* side or on the wall-shaped enclosure 12*c*.

When the concave portion is formed by using a drill as shown in FIG. 6 during the formation of the projection 12*c*1, the top of the projection 12*c*1 is given a conical shape in many cases. In this case, abutting against the cover member 29 is made in a state of being close to a point. The projection 12*c*1, in other words, includes a point that may abut against the cover member 29.

In the meantime, FIG. 7 shows an example in which the concave portion is formed using a so-called pin. The pin, in general, may have a configuration in which a male screw is screwed into a female screw hole. When the male screw is screwed deeply into the female screw hole, the concave portion becomes shallow inside the mold and the projection 12*c*1 is formed to be short. In contrast, when the male screw is screwed shallowly into the female screw hole, the concave portion becomes deep inside the mold and the projection 12*c*1 is formed to be long. If a spacer having a constant thickness is prepared in advance so as to determine the length or the amount in which the pin is screwed into the crew hole, the length of each of the projections 12*c*1 can be freely adjusted.

The minimum required number of the projections 12*c*1, in one example, is three if the plane is to be identified. However, one projection 12*c*1 can serve as a part of the wall-shaped enclosure 12*c*. Also, irregularities in the amount of the applied adhesive can be reduced as well because of the projection 12*c*1. Also, the number of the projections 12*c*1 may exceed three so as to prevent the cover member 29 from being bent due to a wide gap between the projections 12*c*1. Considering that the cover member 29 has a substantially square shape, formation of the projections 12*c*1 at the eight places including the four corners of the wall-shaped enclosure 12*c* and the middle points thereof provides stability.

Figure 15:
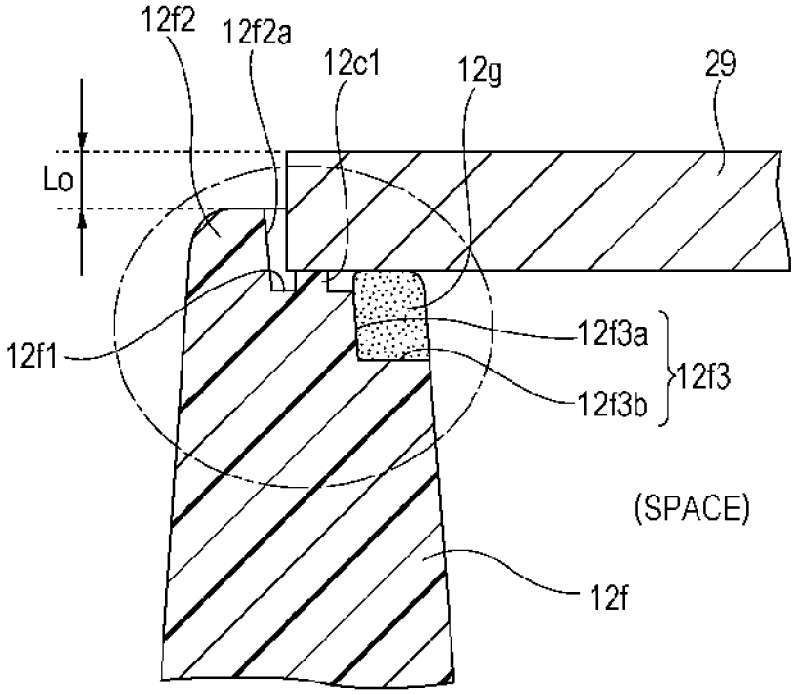
FIG. 15 is a partial cross-sectional view showing a modification example of a wall-shaped enclosure part of the liquid ejecting head.
Figure 16:
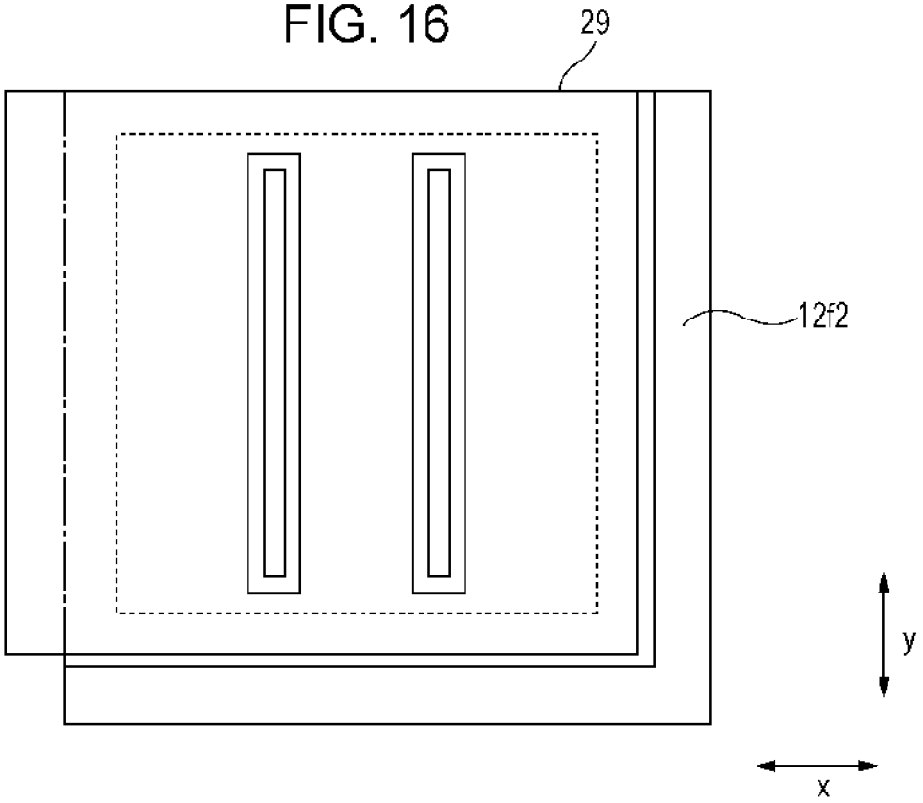
FIG. 16 is a bottom view of the liquid ejecting head.
Figure 17:
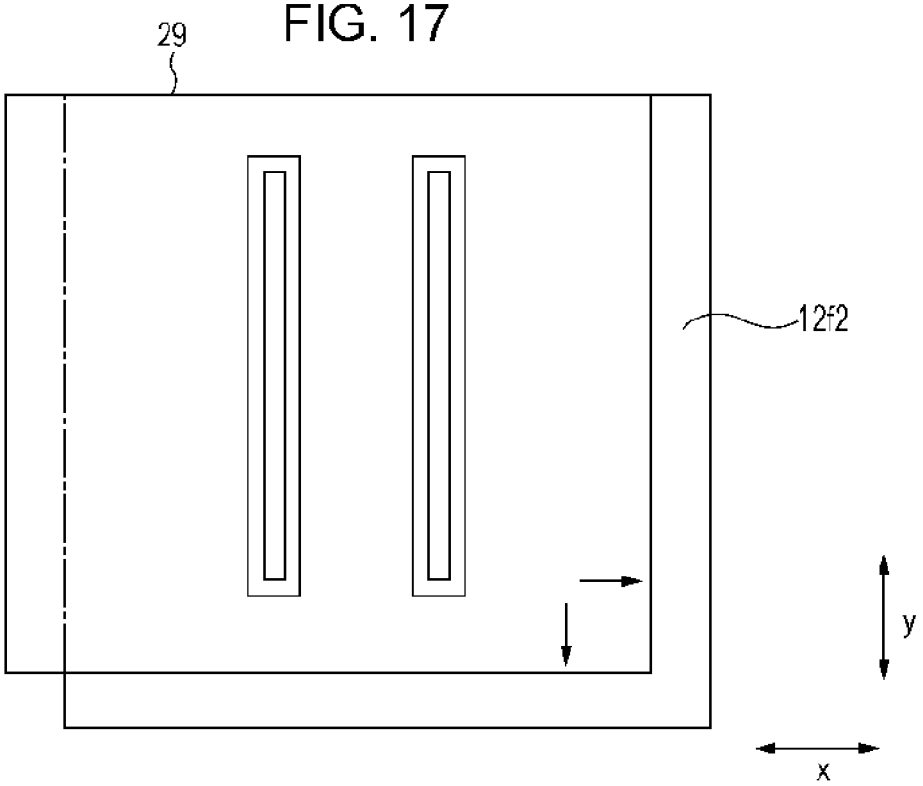
FIG. 17 is a bottom view of the liquid ejecting head.

FIGS. 15 to 17 are, respectively, a cross-sectional view, a first bottom view, and a second bottom view of a wall-shaped enclosure 12*f* according to a modification example.

In a top portion of the wall-shaped enclosure 12*f*, a projecting portion 12*f*2 is formed on an outer circumferential side relative to a top surface 12*f*1 based on the space (space that can accommodate the third flow path member 28) and the projecting portion 12*f*2 projects toward a projecting direction of the wall-shaped enclosure 12*f*. The projecting portion 12*f*2 is formed along with the top surface **12*f*1 where the plurality of projections 12*c*1 described above are formed. In this modification example, the projecting portion 12*f*2 is formed to rise from the top surface 12*f*1 in a so-called bank-like or levee-like manner. The wall-shaped enclosure 12*f* itself may be a rectangular cylinder that forms the space that can accommodate the third flow path member 28 inside. The wall-shaped enclosure 12*f* is similar to the wall-shaped enclosure 12*c* shown in FIG. 5. The levee-shaped projecting portion 12*f*2 is formed to have an L shape when viewed from a bottom surface side at a position on a further outer side than the top surface 12*f*1 as shown in FIG. 16. The projecting portion 12*f*2 may be formed to cover two sides of a top part of the wall-shaped enclosure 12*f*. The projecting portion 12*f*2 is formed on the outer side of the top part of two sides of the wall-shaped enclosure 12*f*. The top portion of the wall-shaped enclosure 12*f* refers to an area shown by an elliptical dashed line in FIG. 15, where the projecting portion 12*f*2 and a concave portion 12*f*3 which will be described later are included in addition to the top surface 12*f*1**.

The projection **12*c*1 is formed on the top surface 12*f*1 and, when the cover member 29 is mounted on the wall-shaped enclosure 12*f* such that the cover member 29 does not collide with the projecting portion 12*f*2 or rest on a top of the projecting portion 12*f*2, the cover member 29 abuts against the top of the projection 12*c*1 formed on the top surface 12*f*1 and the cover member 29 can be maintained in plane. Herein, the projecting portion 12*f*2 has a height and does not project from or past the surface of the cover member 29 based on the projecting direction of the wall-shaped enclosure 12*f* as shown in FIG. 15. The projecting portion 12*f*2 is formed in such a manner that the surface of the cover member 29 is higher by a margin of L0 in one example. If the projecting portion 12*f*2 projects from or past the cover member 29, a wiper 50 that will be described later rises to the projecting portion 12*f*2 and is then moved to fall to the surface of the cover member 29. In this case, ink dregs may be left on the surface of the cover member 29. However, with the positional relationship in which the surface of the cover member 29 projects from the projecting portion 12*f*2 as illustrated in FIG. 15, the wiper 50 rises to the projecting portion 12*f*2 and then further rises to the surface of the cover member 29, and the ink dregs are reliably wiped away in each stage and the surface of the cover member 29 is wiped. In other words, the ink dregs are not left on the surface of the cover member 29**.

Also, the projecting portion **12*f*2 includes a first inclined surface 12*f*2*a* that is connected between a top side of the projecting portion 12*f*2 itself and the top surface 12*f*1, and is formed into an L shape outside two sides of the wall-shaped enclosure 12*f* Accordingly, when the cover member 29 is mounted on the projection 12*c*1 (a predetermined position) as shown in FIG. 17 and is then pressed toward an inner corner of the L shape as shown by the arrows in FIG. 17, a side surface of the cover member 29 is pressed toward (becomes capable of abutting against) the first inclined surface 12*f*2*a* which is an inner-side surface of the projecting portion 12*f*2 and, as a result, the cover member 29 can be guided to a proper position. If the projecting portion 12*f*2 that is formed in this manner has an L shape, guiding the cover member 29 to proper positions is possible in both X and Y directions. In other words, the projecting portion 12*f*2 can function as a positioning member as well for positioning at least the cover member 29**.

In the top portion of the wall-shaped enclosure **12*f*, a continuous concave portion 12*f*3 is formed. The concave portion 12*f*3 is recessed in a corner side based on the projecting direction of the wall-shaped enclosure 12*f* and is formed on a further inner circumferential side than the top surface 12*f*1 in addition to the projecting portion 12*f*2**.

As shown in FIG. 15, the concave portion **12*f*3 is formed in a specific shape to have two surfaces, one being a second inclined surface 12*f*3*a* that extends from the inner circumferential edge of the top surface 12*f*1 to the corner side of the wall-shaped enclosure 12*f* and the other being a mounting surface 12*f*3*b* that is in contact with an end section of the second inclined surface 12*f*3*a* and is connected to an inner circumferential surface of the wall-shaped enclosure 12*f*. In other words, the second inclined surface 12*f*3*a* and the mounting surface 12*f*3*b* are formed in such a manner that a corner portion where the top surface 12*f*1 and the inner circumferential surface of the wall-shaped enclosure 12*f*** are in contact with each other is scraped off.

The concave portion **12*f*3 is an area where an adhesive 12*g* may be applied. Because the concave portion 12*f*3 has a concave shape, the viscous adhesive 12*g* is temporarily held in the concave portion 12*f*3 when applied to the concave portion 12*f*3. This is considered to have an effect of preventing the adhesive 12*g* from flowing down into the space on the inner circumferential side of the wall-shaped enclosure 12*f*. The second inclined surface 12*f*3*a* acts to draw the adhesive 12*g* to the outer circumferential side while the mounting surface 12*f*3*b* supports the adhesive 12*g*** from below.

When the adhesive **12*g* is applied to an extent of rising from the projection 12*c*1 and then the cover member 29 is mounted on the projection 12*c*1 as described above, the adhesive 12*g* is in continuous contact even with a rear side of the cover member 29. As a result, an opening part of the wall-shaped enclosure 12*f* that is a rectangular cylinder and the cover member 29 are attached hermetically or hermetically sealed. In this case, the extra adhesive 12*g* is forced to be moved as the cover member 29 is pressed. With the shape shown in FIG. 5, the extra adhesive 12*g* flows out to both the inside and the outside of the wall-shaped enclosure 12*c* because the adhesive is applied to a surface on the top of the wall-shaped enclosure 12*c*. In contrast, with the shape of the concave portion 12*f*3 shown in FIG. 15, most of the extra adhesive 12*g* is driven inside the wall-shaped enclosure 12*f*. Because a sufficient space is ensured inside the wall shaped enclosure 12*f*, no problem arises even when the adhesive 12*g* flows out along a rear surface of the cover member 29. However, if the adhesive flows outside of the space inside, the adhesive 12*g* may be solidified in a state of projecting from the surface of the cover member 29 and this is not preferable. Also, the second inclined surface 12*f*3*a* and the mounting surface 12*f*3*b* intersect with each other at an angle that is larger than 90°. Thus the extra adhesive 12*g*** is likely to flow to the inside.

Figure 18:
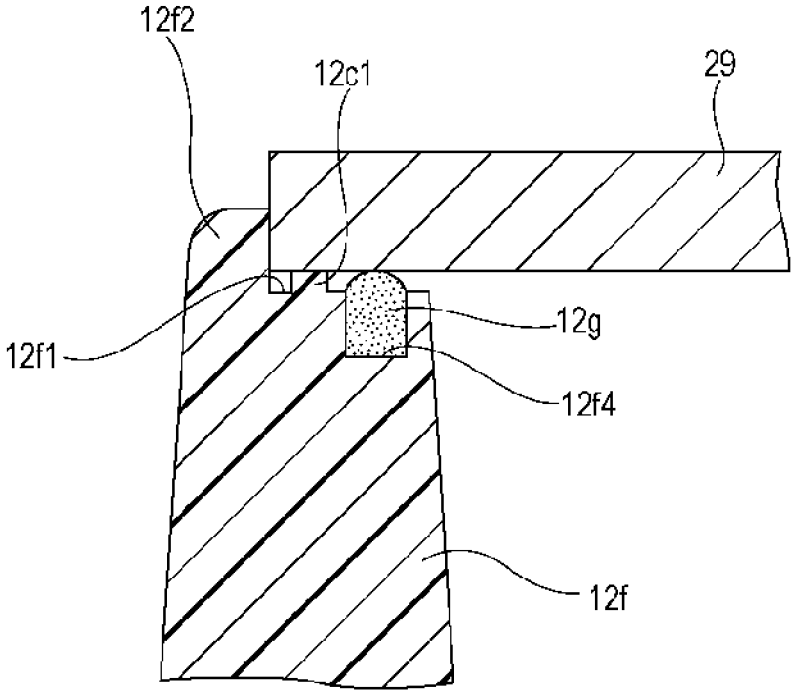
FIG. 18 is a partial cross-sectional view of a wall-shaped enclosure according to another modification example.

The concave portion **12*f*3 that has the second inclined surface 12*f*3*a* and the mounting surface 12*f*3*b* facilitates mold formation, but the concave portion 12*f*3 is not limited to this shape. FIG. 18 shows a modification example of the concave portion. In this example, a concave portion 12*f*4 has a shape of a groove that is continuously formed. The concave portion 12*f*4 is formed at a position that is further to the inner side than the projection 12*c*1 on the top surface 12*f*1. The groove is open in the same direction as an opening of the wall-shaped enclosure 12*f*. The adhesive 12*g* is applied into the groove and the cover member 29 is mounted on the projection 12*c*1 as described above. Even in this case, the opening part of the wall-shaped enclosure 12*f* and the cover member 29 are attached hermetically. Also, as shown in FIG. 18, a side wall on an inner circumferential side of the concave portion 12*f*4 is slightly lower than a side wall on an outer circumferential side. As a result, the extra adhesive 12***g* is likely to be guided inside or to the inside of the wall-shaped enclosure 12*f*.

In this example, the projecting portion 12*f*2 is formed into an L shape and thus is formed in or on a part of an outer circumference of the top surface 12*f*1 which is formed into a shape of a rectangular frame. However, the formation of the projecting portion 12*f*2 does not necessarily have to be made at this position. The projecting portion 12*f*2 may not be continuous along a side of the wall-shaped enclosure 12*f*, for example, but may only be present in certain locations.

Figure 19:
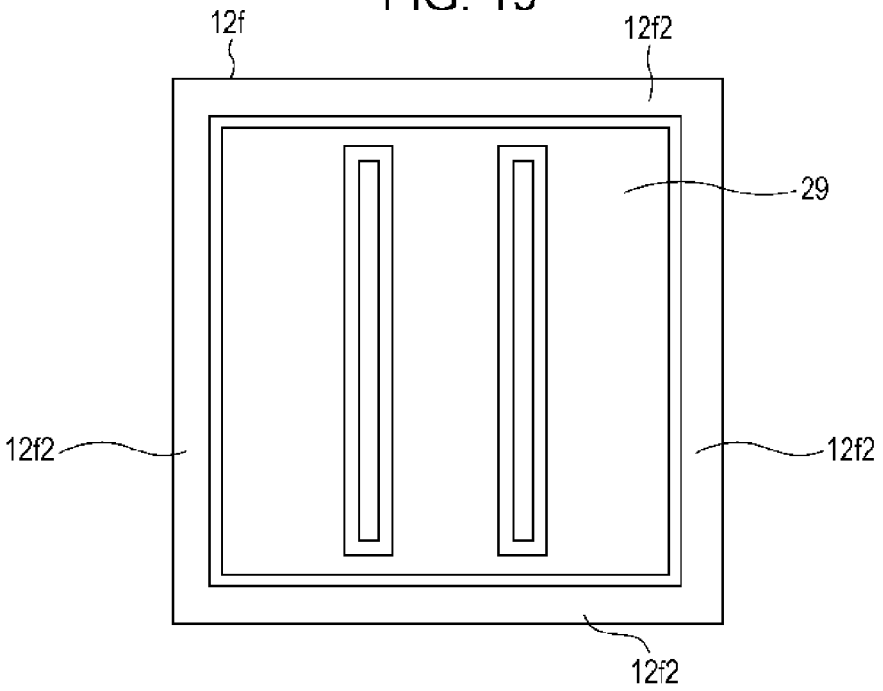
FIG. 19 is a bottom view showing the wall-shaped enclosure according to another modification example.

FIG. 19 is a bottom view showing a modification example of the projecting portion. In this example, the projecting portion 12*f*2 is formed to cover or formed on the entire outer circumference of the top surface 12*f*1, which is formed into the shape of the rectangular frame. The arrangement may be made in this manner as well.

The projecting portion that is described above may have a shape of a levee or the like which rises continuously along each side of the wall-shaped enclosure 12*f*. However, the shape does not necessarily have to be the shape of the levee, and various modifications are possible.

Figure 20:
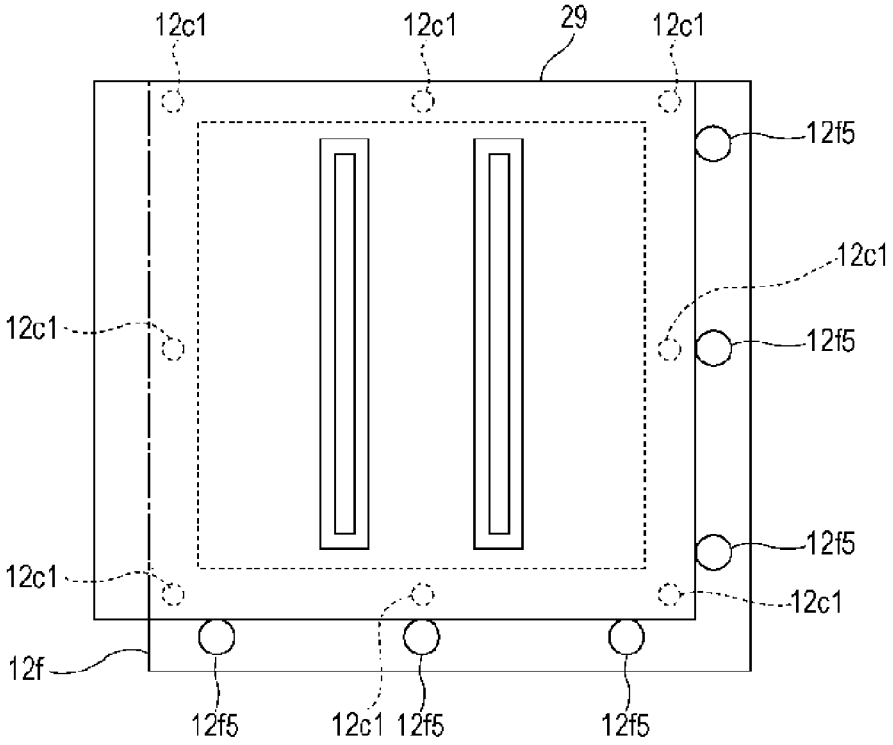
FIG. 20 is a bottom view showing another modification example of a projecting portion.
Figure 21:
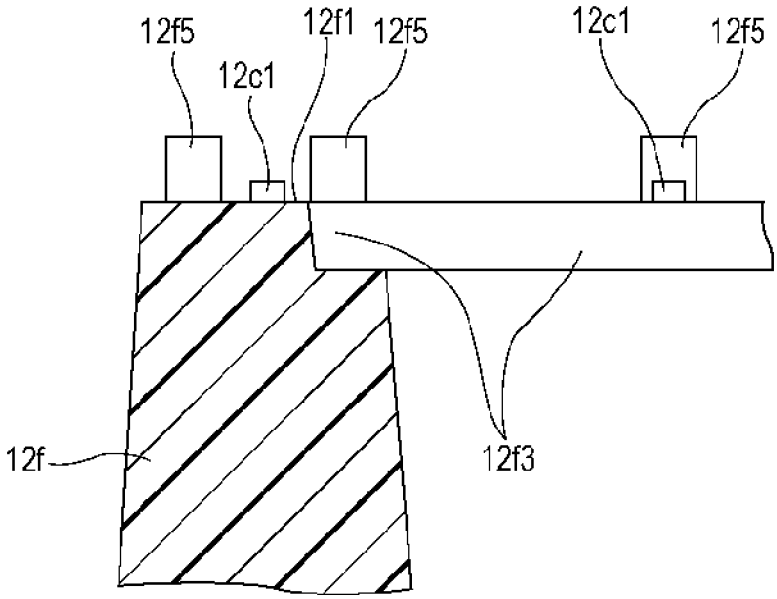
FIG. 21 is a partial cross-sectional view showing a modification example of the projecting portion.

FIGS. 20 and 21 show projecting portions 12*f*5 that are discretely formed into a columnar shape. Even in this modification example, when the cover member 29 abuts against the projection 12*c*1 thereon, the side surface of the cover member 29 abuts against a side surface of the projecting portion 12*f*5. Thus the above-described positioning effect is achieved. Also, because the concave portion 12*f*3 is formed in the wall-shaped enclosure 12*f*, the extra adhesive 12*g* flows out mainly inside the wall-shaped enclosure 12*f* when the cover member 29 is mounted. As a matter of course, with the projecting portion 12*f*2 that has the levee shape shown in FIGS. 15 and 18, the levee shape blocks the way when even a small amount of the adhesive 12*g* attempts to flow outside. Thus, flow of the adhesive to the outside of the wall-shaped enclosure 12*f* is prevented. However, such an effect cannot be expected in a case of the discrete projecting portion 12*f*5. Still, most of the adhesive 12*g* flows to the inside of the wall-shaped enclosure 12*f* because of the concave portion 12*f*3. The adhesive that leaks to the outside or outside of the wall-shaped enclosure 12*f* is almost negligible. Under a condition where the formation of the columnar-shaped projecting portion 12*f*5 is easy, the same effect can be achieved even though the projecting portion 12*f*5 does not have the levee shape.

Figure 8:
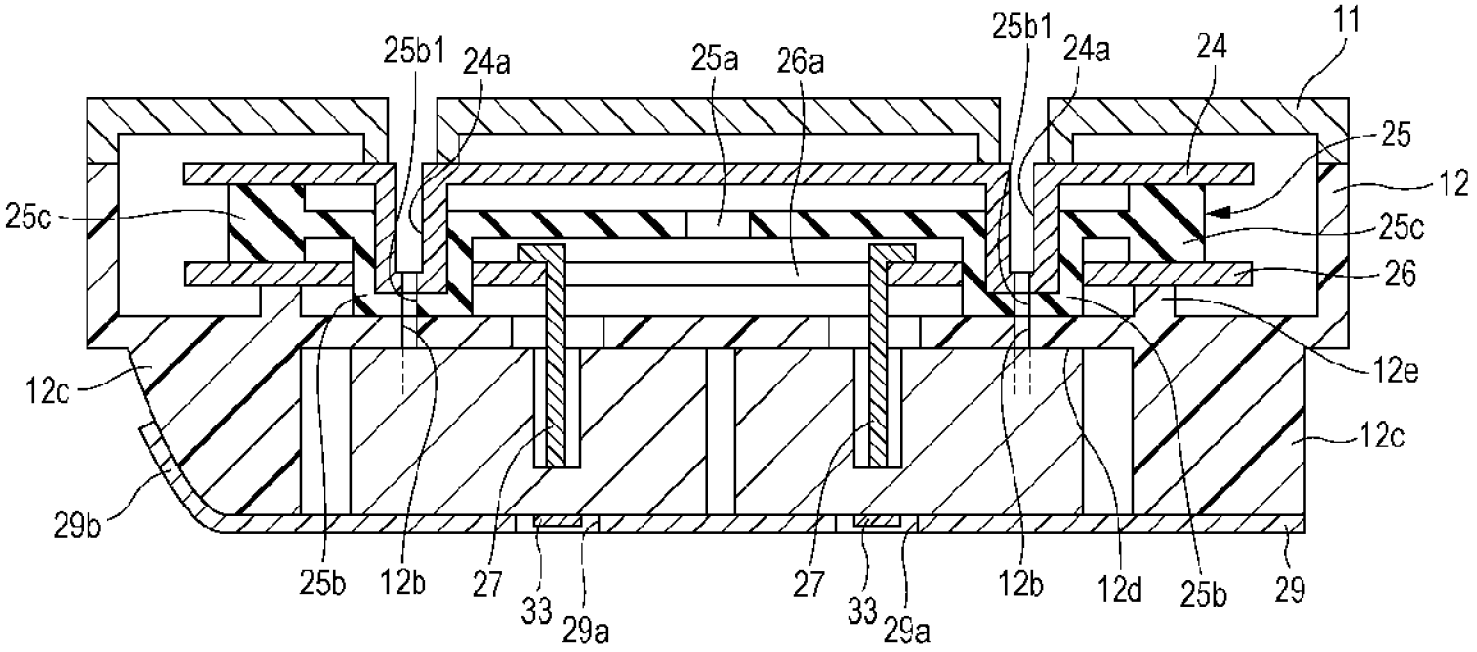
FIG. 8 is a schematic cross-sectional view showing an overall internal configuration of the case member.
Figure 9:
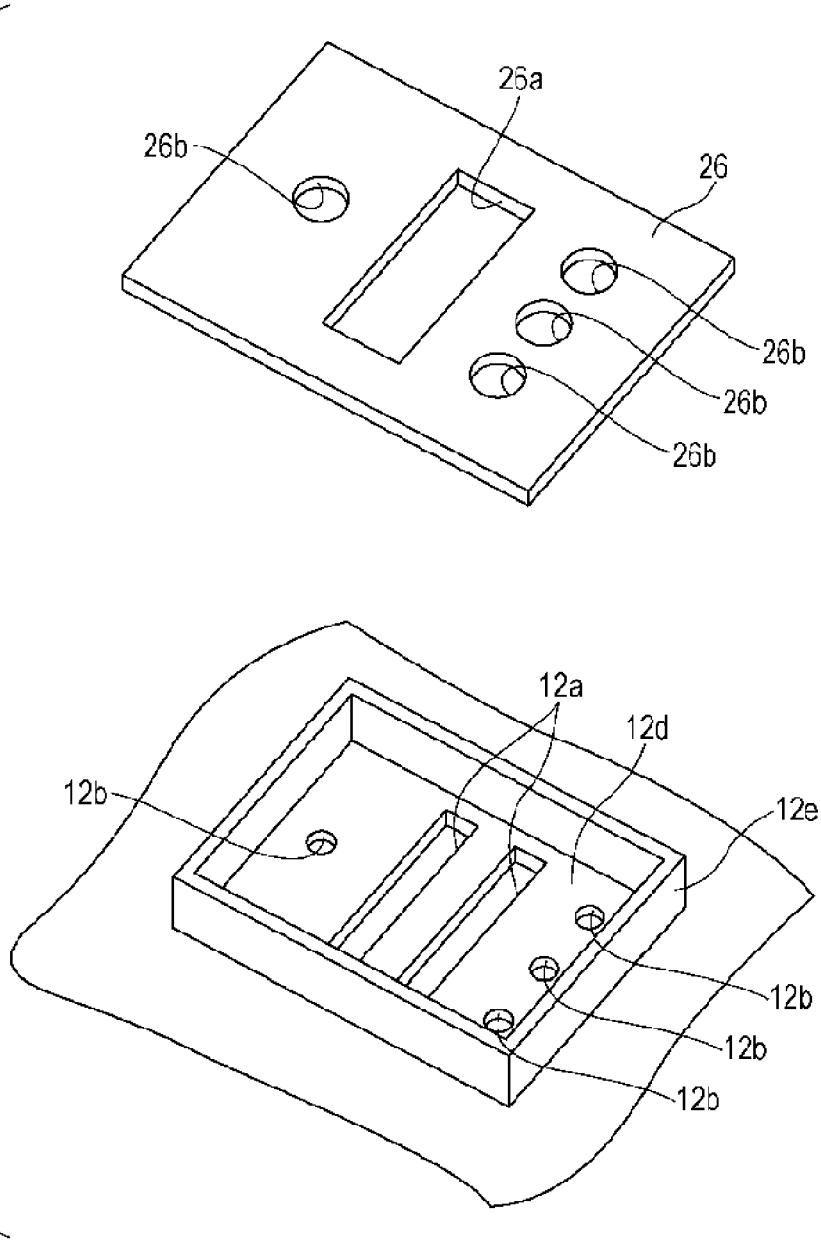
FIG. 9 is a schematic perspective view showing the overall internal configuration of the case member.

Next, FIG. 8 is a schematic cross-sectional view showing an overall internal configuration of the case member, and FIG. 9 is a schematic perspective view showing the overall internal configuration of the case member.

The lower case member 12 forms a predetermined accommodating space on an upper side of a bottom wall 12*d* where the through-hole 12*a* and the case member communication path 12*b* are formed when combined with the upper case member 11. An inner rib 12*e* that has a rectangular cross section in one example is formed in a projecting manner upward from the bottom wall 12*d*, and the through-hole 12*a* and the case member communication path 12*b* are formed on an inner side relative to the inner rib 12*e*. The circuit substrate 26 is mounted on a top of the inner rib 12*e*, and the seal member 25 and the flow path member 24 are mounted thereon. The top of the inner rib 12*e* identifies a plane that can be in close contact with the circuit substrate 26. The top of the inner rib 12*e*, in this sense, forms a planar section and the circuit substrate is mounted on the planar section.

The circuit substrate 26 has an external shape that is larger than the inner rib 12*e*, and the top of the inner rib 12*e* may abut continuously against a lower surface of the circuit substrate 26 in a state where the circuit substrate 26 is mounted on the inner rib 12*e*. The part where the top of the inner rib 12*e* and the circuit substrate 26 abut against each other is hermetically fixed or sealed by applying a predetermined amount of a hermetic adhesive in advance to the top of the inner rib 12*e*. The inner rib 12*e* itself may be a three-dimensional cylindrical object and the planar circuit substrate 26 is attached to and set in the planar section formed in the opening thereof so that rigidity of the entire lower case member 12 can be increased around the inner rib 12*e*. The circuit substrate 26 may include a print substrate. Multiple leads which are electrically connected to the flexible substrate 27 are formed in or on an edge portion of a through port 26*a*. Also, a lead terminal (not shown) is formed in or on an outer edge portion as well, and the lead terminal is electrically connected to the outside via a connector.

A through port 26*b* is formed at a position on the circuit substrate 26 that corresponds to the case member communication path 12*b* of the lower case member 12. In this case, the through port 26*b* is formed at the position that corresponds to the case member communication path 12*b* and the case member communication path 12*b* is in a state of being exposed in an up-down direction. The case member communication path 12*b* communicates with the communication path 28*b* of the third flow path member 28 through a passage (not shown) as described above.

The seal member 25 that may be formed from a rubber material, for example an elastomer, has an external shape that is smaller than the external shape of the circuit substrate 26, but has an external shape that is at least larger than an area including the through port 26*a* and the through port 26*b*. The seal member 25 includes a small through port 25*a* formed in the center thereof. Also, a convex part 25*b* that projects downward and is formed into a cup shape is formed at positions corresponding to each of the through ports 26*b* of the circuit substrate 26. The convex part 25*b* is fitted into an inner circumferential surface of the through port 26*b* on an outer circumferential surface of a cup-shaped cylindrical part to fulfill a positioning function when inserted into the through port 26*b* of the circuit substrate 26. A cup-shaped bottom surface abuts against a circumferential edge portion of the opening of the case member communication path 12*b*. A through port 25*b*1 is also formed in the bottom surface to form a communication passage communicating with the case member communication path 12*b*.

A continuous seal part 25*c* whose thickness continuously increases upward and downward is formed on a circumferential edge of the seal member 25, and a lower surface of the continuous seal part 25*c* is in close contact with an upper surface of the circuit substrate 26 and an upper surface thereof is in close contact with a lower surface of the flow path member 24 when the flow path member 24 is mounted on the seal member 25. A cylindrical communication path 24*a* that corresponds to the convex part 25*b* of the seal member 25 and projects downward is formed in the flow path member 24. The length thereof is equivalent to the length of a lower end of the communication path 24*a* in contact with the bottom surface in the convex part 25*b* when the flow path member 24 is mounted on the seal member 25 and is in contact with the continuous seal part 25*c*. The flow path member 24 is accommodated in such a manner as to be pressed downward in the lower case member 12. In this case, the flow path member 24 abuts against the continuous seal part 25*c* in a circumferential edge part and the communication path 24*a* abuts against the bottom surface in the convex part 25*b*. Also, the continuous seal part 25*c* of the seal member 25 continuously abuts against the circumferential edge part of the circuit substrate 26 on a lower surface thereof and a lower surface side of the bottom surface of the convex part 25*b* abuts against the circumferential edge portion of the opening of the case member communication path 12*b*. When a predetermined pressing force is added from the flow path member 24, the seal member 25 achieves a sealing function in the abutting part in the above-described manner.

In one example, the communication path 24*a* of the flow path member 24 corresponds to a first communication path, the case member communication path 12*b* corresponds to a second communication path, and the communication path 28*b* of the third flow path member 28 corresponds to a third communication path. In FIG. 8, the communication path 28*b* is not shown for simplicity. An opening in which a predetermined space is formed inside by the wall-shaped enclosure 12*c* is formed on a printing medium side of the lower case member 12, and the third flow path member 28 in a state where the head chip 30 is held is set in the lower case member 12 in the predetermined space. The opening is blocked in a state where a nozzle surface of the head chip 30 is exposed to the outside by the cover member 29. Further, the seal member 25, which causes the first communication path and the second communication path to communicate with each other in a liquid-tight manner, is interposed between the flow path member 24 and the lower case member 12 via the circuit substrate 26 in a stacking direction of the flow path member 24. The seal member 25 seals an opening-side space in the lower case member 12. In other words, a liquid-tight structure can be formed in a predetermined part just through stacking members with the seal member 25 being interposed between the members. Compared to a case where the seal member is formed by separate bodies, the formation of the integrated seal member is likely to result in a reduction of the size of the entire seal member and an improvement in ease of assembly because the number of components is reduced.

In this case, because the through port 25*a* is formed in the seal member 25, both the space on a lower side of the seal member 25 and the space generated between the seal member 25 and the flow path member are sealed. Also, in one example, a path open to the atmosphere is formed on an upper surface of the continuous seal part 25*c*. The path may be a narrow groove and this path allows an inner circumferential side and an outer circumferential side to communicate with each other on the upper surface of the continuous seal part 25*c*. In other words, the path open to the atmosphere is formed into a groove-shaped part that is formed in a close contact surface in the stacking direction.

As a result, a large amount of gas does not move in and out because the groove shape is significantly narrow. However, a very small amount of gas moves in and out. In embodiments of the invention, a sealed state where the movement of this amount of gas is allowed is obtained. This is used so that the very small pressure change generated during a displacement of the above-described compliance member 40 is transmitted to the outside through the opening.

In one embodiment, the flow path member 24 is covered by the upper case member 11, and an ink cartridge (not shown) that is a holding member for the discharge liquid is mounted and set on the upper case member 11. The passage reaching the flow path member 24 from the ink cartridge via the upper case member 11 also has to be a liquid-tight communication path and, in one embodiment, a liquid-tight structure using an O-ring (not shown) or the like is formed. Also, the upper case member 11 may be screwed to and set in the lower case member 12 from a lower side of the case, and a pressing force is generated downward in the above-described stacking direction by the flow path member 24 when the upper case member 11 approaches the lower case member 12 to be fastened.

Even when the seal member 25 is pinched and fastened by screwing the upper case member 11 to the lower case member 12 in this manner, the planar substrate that is attached to and set in the above-described wall-shaped enclosure 12*c* and further the inner rib 12*e* effectively suppresses the lower case member 12 from bending or deforming. During the assembly of the seal member 25 between the upper case member 11 and the lower case member 12, a cumbersome operation in which the adhesive is used is not necessary. Just pinching allows the assembly to be assembled with simplicity.

The communication paths for the ink that reaches the head chip 30 from the ink cartridge are the communication path 24*a* (first communication path) of the flow path member 24, the case member communication path 12*b* (second communication path), and the communication path 28*b* (third communication path) of the third flow path member 28 as described above. Since the ink is supplied to the head chip 30 through the flow path in each of the members accommodated in the internal space formed by the upper case member 11 and the lower case member 12, the ink is not easily dried. However, in the part that is set using the adhesive, the possibility that the ink will dry easily is considered and can depend o on gas barrier properties of the adhesive. In a case where the head chip 30 is smaller in size than in the related art, an effect where the ink becomes thickened due to drying becomes significant because the absolute amount of the ink held inside is small. In one embodiment, a modified epoxy resin is used as the adhesive. A modified epoxy resin has flexibility. As a result, peeling or separation of the member or members is unlikely to be generated when using a flexible adhesive to fix or bond members with each other. The modified epoxy resin has high flexibility but low gas barrier properties. As a result, the moisture contained in the ink permeates to the outside and causes the ink to thicken. However, as described above, the head chip 30 or the like is held in the space that is sealed by the seal member 25 and the sealed space is filled with the permeated moisture. Thus, more permeation is unlikely to occur and the structure becomes resistant to the thickening of the ink. Also, the flow path formed from the first communication path and the second communication path described above is identified inside the case member and is surrounded by the upper case member 11 and the lower case member 12. The flow path for the discharge liquid from an upstream side corresponding to the ink cartridge toward a downstream side corresponding to the third communication path is formed.

In a case where printing is performed with a liquid ejecting apparatus on which the liquid ejecting head is mounted, the nozzle surface may be cleaned at a certain frequency. The nozzle surface may be cleaned by wiping contamination on the surface with a wiper formed from an elastic material.

Figure 10:
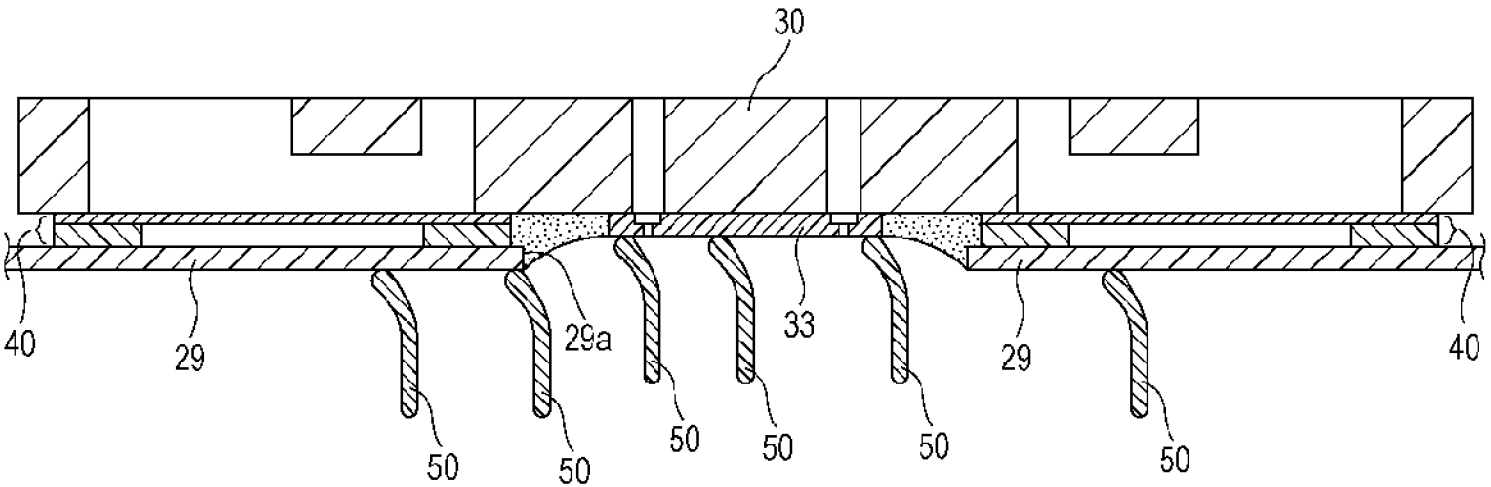
FIG. 10 is a schematic cross-sectional view showing an example wipe process.

FIG. 10 is a schematic cross-sectional view showing the wipe process.

As described above, the nozzle plate 33 is held in the opening 29*a* of the cover member 29 at a position further recessed than the surface of the cover member 29.

A wiper 50 may be set at a position that is shifted from a printing area and that is within a range of main scanning of the liquid ejecting head. A top of the wiper 50 wipes the cover member 29 and the surface of the nozzle plate 33 as the liquid ejecting head is relatively moved with respect to the wiper 50 and a wiping part of the wiper 50 wipes the ink remaining on both of the surfaces. This operation is referred to as wiping. As shown in FIG. 10, a top-sided part of the wiper 50 is moved to slide upward as a first step when moving from the almost flat surface of the cover member 29 to the surface of the nozzle plate 33 in the opening 29*a* and is moved to slide downward as a second step when finishing the surface of the nozzle plate 33 and moving back to the surface of the cover member 29. When the step parts are not smoothly continuous, the ink or the like that is collected on the top of the wiper 50 is captured in a non-continuous part, and the liquid ejecting head may not be clean.

In one embodiment, the step generated between the nozzle plate 33 and the cover member 29 is filled with a filling material so that the surfaces are smoothly connected with each other.

Figure 11:
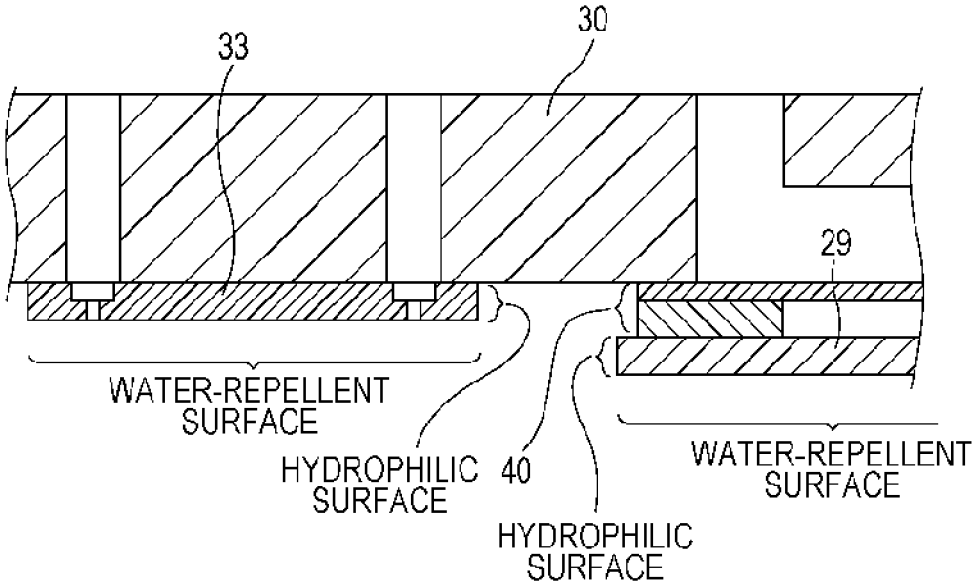
FIG. 11 is a schematic cross-sectional view showing an example nozzle plate and an example cover member.
Figure 12:
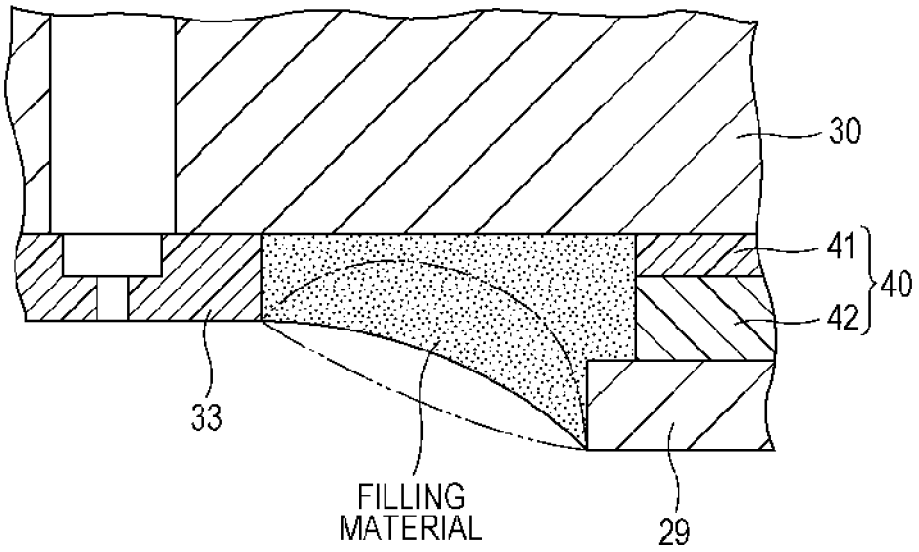
FIG. 12 is a schematic cross-sectional view showing a state where an amount of a filling material differs.

FIG. 11 is a schematic cross-sectional view showing the nozzle plate and the cover member, and FIG. 12 is a schematic cross-sectional view showing a state where the amount of the filling material differs.

The space filled with the filling material is a part or location surrounded by a side surface of the nozzle plate 33, a lower surface of the head chip 30, a side surface of the compliance member 40, and an extremely small part of a lower surface and the side surface of the cover member 29. When the amount of the filling material is large, overflowing is caused and a filling agent may capture the ink. When the amount of the filling material is small, permeation is not made in a part where the permeation is required and a concave portion is formed so that the concave portion may capture the ink. Also, when the amount of the filling material is small, the side surface of the nozzle plate 33 may be in an exposed state. Because the nozzle plate 33 is formed of silicon as described above and is vulnerable to static electricity, there is a concern that the nozzle plate 33 may be electrostatically broken down.

Accordingly, the space may be filled with an amount of the filling material that is less than a predetermined amount. As shown in FIG. 11, both or at least one of the surfaces and the side surfaces may be subjected to a coating treatment so that the lower surfaces of the nozzle plate 33 and the cover member 29 become water-repellent surfaces and the side surfaces of the nozzle plate 33 and the cover member 29 become relatively hydrophilic surfaces with respect to the surfaces of the lower surfaces. Then, when the small amount of the filling material begins to fill the space, the filling material spreads on the hydrophilic surfaces of the side surfaces of the nozzle plate 33 and the cover member 29 from when the amount of the filling material is not sufficient and the filling material creeps up the side surfaces in such a manner as to cover the entire side surfaces. The spreading is due to the so-called principle of surface tension. The spreading is initiated from when the amount of the filling material is small.

In FIG. 12, the solid line shows the optimum designed amount of the filling material. However, even in a case shown with the dashed line where the amount of the filling material is small, the filling material spreads up the hydrophilic surfaces of the side surfaces of the nozzle plate 33 and the cover member 29, and thus a gap or the like generated by the filling material not being filled along at least the side surfaces of the nozzle plate 33 and the cover member 29 does not occur. Also, the specified amount is to the extent of being slightly recessed compared to the straight line linking edge portions of the surfaces of the nozzle plate 33 and the cover member 29 with each other. This state is a state where an exposed part of the filling material forms a slightly recessed surface. Even when the filling is made to exceed a necessary amount in a rare case, the surfaces of the nozzle plate 33 and the cover member 29 are treated to be water-repellent and thus the filling material does not spread along these surfaces.

Also, epoxy and an adhesive can be applied as the filling material, but examples thereof are not limited thereto.

In other words, when the lower surface of the liquid ejecting head is formed by the nozzle plate 33 and the cover member 29, the surface of the nozzle plate 33 and the surface of the cover member 29 are the water-repellent surfaces and the side surfaces of the nozzle plate 33 and the cover member 29 are the relatively hydrophilic surfaces compared to the water-repellant surfaces and the gap between the nozzle plate 33 and the cover member 29 is filled with the filling material. If at least the side surface of the nozzle plate 33 is covered by the filling material, the nozzle plate 33 can be protected from static electricity. Further, if the side surface of the cover member 29 is covered by the filling material, wiping by the wiper 50 is improved.

Figure 13:
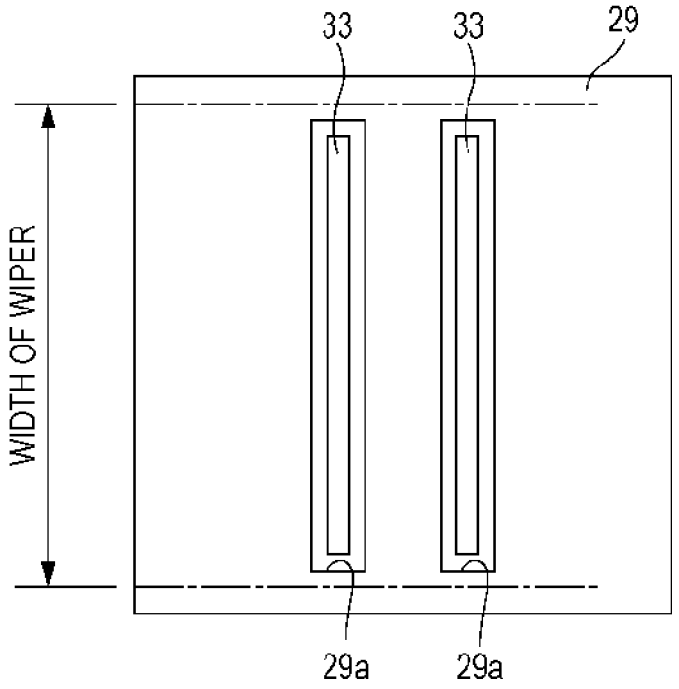
FIG. 13 is a schematic bottom view showing a state where the cover member is viewed from below.
Figure 14:
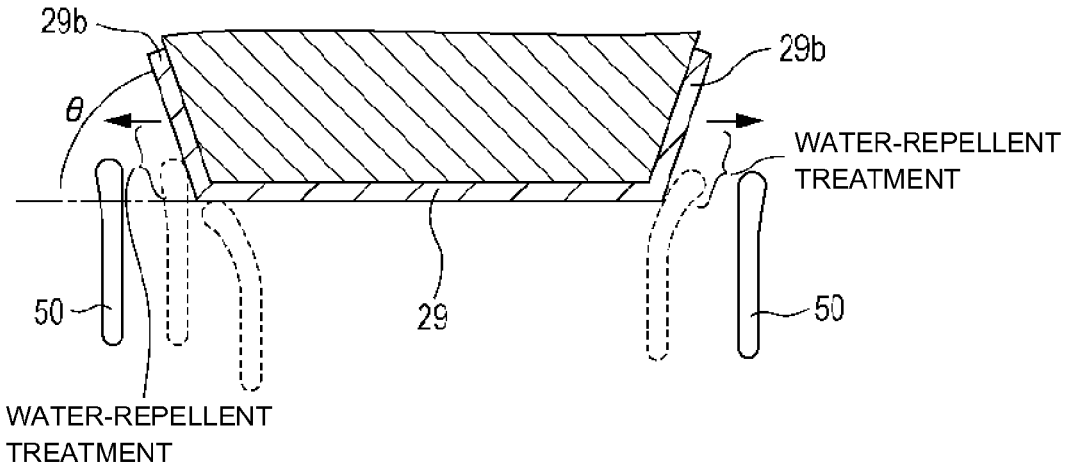
FIG. 14 is a schematic side view showing a state where the cover member and a wiper abut against each other.

FIG. 13 is a schematic bottom view showing a state where the cover member is viewed from below, and FIG. 14 is a schematic side view showing a state where the cover member and the wiper abut against each other.

The nozzle plate 33 has a strip-like long shape, and the above-described gap is generated along each of the two sides of the long side and the short side. The nozzle 33*a* is formed along the long side direction and the liquid ejecting head has a direction orthogonal to the long side. The wiper 50 is moved in a direction orthogonal to the relative long side, and the ink is likely to enter the gap on the long side. In this sense, it is effective to render the step of the surface smooth by using the above-described filling agent in a direction crossing the direction in which the liquid ejecting head is moved.

In order for the wiper 50 to effectively wipe the surfaces of the cover member 29 and the nozzle plate 33, the wiper 50 itself may have elasticity and the distance between the wiper 50 and both the cover member 29 and the nozzle plate 33 has to have a positional relationship to the extent of the wiper 50 being bent while abutting. When the wiper 50 has the length to the extent of being bent is a timing when the liquid ejecting head is driven and an end section of the cover member 29 begins to abut against the wiper 50.

In one embodiment, an end section part of the cover member 29 is bent across a predetermined length toward the wiping direction, and an angle θ of the lower surface with respect to the plane may be 45° to 80°. As shown in FIG. 14, when the liquid ejecting head is driven and the wiper 50 begins to abut relatively against the end section of the cover member 29, the top of the wiper 50 first abuts against a bent end section 29*b* of the cover member 29. Then, the top of the wiper 50 is gradually bent and wipes the lower surface of the cover member 29 and the surface of the nozzle plate 33 described above to wipe the contamination such as the ink. The wiped ink gradually remains on the surface of the wiper 50, and the ink that remains on the wiper 50 is likely to be attached to the vicinity of the bent end section 29*b* against which the wiper 50 abuts first. Accordingly, the water-repellent treatment is performed in advance in both the wiper 50 and the vicinity of the bent end section 29*b* so that the ink is likely to come off naturally before being gradually attached to the wiper 50 or the attached ink is moved to the bent end section 29*b* and accumulated. Also, the water-repellent treatment may be performed across the entire surface of the cover member 29, but the above-described effect can be obtained if the water-repellent treatment is performed in the part where the wiper 50 first abuts against the bent end section 29*b* and the vicinity thereof. Also, the ink is likely to come off following the water-repellent treatment when the bent end section 29*b* has an angle of 45° to 80°. Also, although FIG. 14 is a schematic view, the bent end section 29*b* is disposed on both sides based on the direction in which the liquid ejecting head is driven. In this case, the wiping of the cover member 29 and the nozzle plate 33 can be performed effectively on the surface on the side opposite to the wiper 50 when the liquid ejecting head passes through the holding position of the wiper 50 and is reversed again.

Also, embodiments of the invention are not limited to the above-described embodiments, but the followings are appreciated by those skilled in the art as embodiments of the invention.

The mutually replaceable members, configuration, and the like disclosed in the above-described embodiment can be applied through an appropriate change in combination thereof.

The members, configuration, and the like disclosed in the above-described embodiment as the related art and the mutually replaceable members, configuration, and the like can be applied through an appropriate replacement or a change in combination thereof.

The members, configuration, and the like that are disclosed in the above-described embodiment and can be assumed and replaced by those skilled in the art based on the related art can be applied through an appropriate replacement or a change in combination thereof.

What is claimed is:

1. A liquid ejecting head comprising:

a case member that includes a communication path that causes ink to communicate from an upstream side to a downstream side, wherein the case member is resin-molded; and a cover member in which a head chip is set, wherein a wall-shaped enclosure, that is disposed through integral molding with the case member to form a predetermined space inside, is provided on a printing medium side of the case member and a plurality of projections are formed apart from each other on the wall-shaped enclosure on a printing medium side surface of the wall-shaped enclosure, the plurality of projections are formed at at least four corners of the wall-shaped enclosure and at at least between the four corners on each side of the wall-shaped enclosure, and wherein the cover member is fixed to the case member in a part of the plurality of projections to contain the head chip in the predetermined space formed by the wall-shaped enclosure and wherein the head chip communicates with the communication path in the predetermined space.

2. The liquid ejecting head according to claim 1, wherein a cross section of the wall-shaped enclosure is formed into a cylinder having a substantially square shape.

3. The liquid ejecting head according to claim 1, wherein a plane is identified on tops of the plurality of projections and the plane is parallel with a nozzle surface of the head chip.

4. The liquid ejecting head according to claim 1, wherein the printing medium side of the plurality of projections has a conical shape.

5. The liquid ejecting head according to claim 1, wherein a projecting portion is formed on an outer circumferential side of a printing medium side surface of the wall-shaped enclosure based on the predetermined space and wherein the projecting portion project in the same direction as the plurality of projections, wherein the projecting portion is formed along with the printing medium side surface where the plurality of projections are formed.

6. The liquid ejecting head according to claim 5, wherein the projecting portion is formed to have a height that does not project from a surface of the cover member.

7. The liquid ejecting head according to claim 5, wherein a side surface of the cover member abuts against the projecting portion in a state where the cover member is mounted at a predetermined position.

8. The liquid ejecting head according to claim 5, wherein the projecting portion includes a first inclined surface that is connected between a printing medium side of the projecting portion and the printing medium side surface.

9. The liquid ejecting head according to claim 6, wherein the projecting portion is formed in a part of an outer circumference of the printing medium side surface.

10. The liquid ejecting head according to claim 5, wherein a continuous concave section that is formed to be recessed to a corner side relative to the projecting direction of the wall-shaped enclosure is formed in the printing medium side portion of the wall-shaped enclosure on an inner circumferential side from the printing medium side surface.

11. The liquid ejecting head according to claim 10, wherein the concave section is formed to have two surfaces, a first surface being a second inclined surface that extends from an inner circumferential edge of the printing medium side surface to the corner side of the wall-shaped enclosure and a second surface being a mounting surface that is in contact with an end section of the second inclined surface and that is connected to an inner circumferential surface of the wall-shaped enclosure.

12. A liquid ejecting apparatus that performs printing by relatively moving a liquid ejecting head and a printing medium, wherein the liquid ejecting head includes:

a case member that includes a communication path that causes ink to communicate from an upstream side to a downstream side, wherein the case member is resin-molded; and a cover member in which a head chip is set, wherein a wall-shaped enclosure that is disposed through integral molding with the case member to form a predetermined space inside is provided on a printing medium side of the case member and a plurality of projections are formed apart from each other on a top of the wall-shaped enclosure on a printing medium side surface of the wall-shaped enclosure, the plurality of projections are formed at at least four corners of the wall-shaped enclosure and at at least between the four corners on each side of the wall-shaped enclosure, and wherein the cover member is fixed to the case member in a part of the plurality projections to contain the head chip in the predetermined space formed by the wall-shaped enclosure and wherein the head chip communicates with the communication path in the predetermined space.

13. The liquid ejecting apparatus according to claim 12, wherein a projecting portion is formed on an outer circumferential side of a printing medium side surface of the wall-shaped enclosure based on the predetermined space and wherein the projecting portion projects toward a projecting direction of the wall-shaped enclosure, wherein the projecting portion is formed in a printing medium side portion of the wall-shaped enclosure along with printing medium side surface where the plurality of projections are formed.

* * * * *